United States Patent [19]

Dettin

[11] Patent Number: 4,852,270

[45] Date of Patent: Aug. 1, 1989

[54] HYDROEXTRACTOR FOR YARNS ON A REEL

[75] Inventor: Piergiorgio Dettin, Schio, Italy

[73] Assignee: F.lli Dettin S.p.a., Schio Vicenza, Italy

[21] Appl. No.: 119,844

[22] Filed: Nov. 12, 1987

[30] Foreign Application Priority Data

Dec. 4, 1986 [IT] Italy ..... 85.642

[51] Int. Cl.[4] ..... F26B 15/08

[52] U.S. Cl. ..... 34/58; 68/23 R; 68/210; 414/744.3

[58] Field of Search ..... 68/23 R, 23.3, 210; 494/33, 82; 210/322, 359; 34/8, 58; 414/222, 744 R

[56] References Cited

U.S. PATENT DOCUMENTS 2,452,638 11/1948 Drum et al. ..... 34/58 X
4,464,846 8/1984 Itoh et al. ..... 34/58
4,545,135 10/1985 Barriquand et al. ..... 68/23 R X

FOREIGN PATENT DOCUMENTS 76965 5/1984 Japan ..... 68/23 R
1215759 9/1986 Japan ..... 68/23 R
2057978 3/1987 Japan ..... 34/58
460343 9/1975 U.S.S.R. ..... 68/210
696251 11/1979 U.S.S.R. ..... 34/58

*Primary Examiner*—Philip R. Coe
*Attorney, Agent, or Firm*—Bucknam and Archer

[57] ABSTRACT

The apparatus comprises two basins (1 and 2), baskets (3) which rotate in the interior of the basins. The baskets support loaders (4) which carry the reels. The loaders are actuated by a carousel conveyor (10) which is guided in its movement upwardly and downwardly by a central column (13). The carousel conveyor may rotate an 180° angle. The apparatus permits loading of the reels with yarns to be treated and unloading of reels having yarns which have already been treated, thus eliminating the dead time of the different phases of operation. The apparatus is hydraulically operated, including the motion of the baskets (3) actuated by motor (18) by means of the hydraulic gearbox and electric control panel (26). The latter controls automatically by means of a logical circuit all the necessary operations for good functioning of the apparatus.

4 Claims, 7 Drawing Sheets

FIG. 3

HYDROEXTRACTOR FOR YARNS ON A REEL

The present invention relates to an apparatus which comprises a plurality of rotating baskets, the apparatus being used as a hydroextractor of yarns on reels. It is well known that the yarns of wool, cotton, artificial fibers, etc. which are wound on reels, after having been immersed in a dyeing bath, must be subjected to a step of hydroextraction, which is necessary prior to proceeding with subsequent operations. Actually, the yarns on the reels at the end of the phase of immersion in the dyeing bath, go to the phase of hydroextraction after having been placed in the interior of rotating baskets which reels are located on differentiated circumferences which start from the exterior of the same baskets and converge towards the center. This step, however, inevitably causes lack of uniformity of the degree of extraction in the individual reels, as a result, not only of the fact that the reels which are located in the exterior are subjected to a greater action of centrifugal force, but also due to the fact that the reels become piled up one over the other.

An object of the present invention is to provide a hydroextractor for the yarns on the reels which comprises rotating baskets with the reels and the yarns being placed in the interior of the baskets. The reels are supported by suitable spokes which form loaders. Provision is being made for the reels to be displaced only in the radial direction by means of slits made in the same reels, so that under the action of the centrifugal force the reels rest on the interior walls of the baskets.

Another feature of the apparatus according to the present invention is that each assembly which comprises the rotating basket, a controlling shaft, a sleeve which guides the shaft and an hydraulic motor is suspended from a suitable device, resiliently supported by a triple plurality of springs which operate by traction. Further a plurality of shock absorbers compensate the unevenness of the load which is placed in the interior of the rotating baskets so that a perfectly uniform rotating motion is achieved, and further, the motion is essentially noiseless, even at high speed such as 1,500 turns per minute, thus resulting in substantial advantages of efficiency of the apparatus and its noiselessness.

Another feature of the present invention is that the loaders which carry the reels, for instance in number of four, are supported by a carousel conveyor which is hydraulically controlled and which is formed by a spider having four arms. This carousel conveyor offers the possibility of lifting itself, thus extracting from the baskets two loaders of the reels which have already been worked on, making a rotation of 180° and lowering again, thus loading the baskets with two new loaders. Further, the carousel conveyor permits at the same time to place the two loaders of the reels which have already been worked on on a suitable loading and unloading plane, so that the operator during the dead time of centrifugation has the possibility of preparing the two successive loaders by unloading the reels already worked on and placing on the loaders the reels which are going to be worked on.

The assembly is obviously provided with all the necessary controls to carry out automatically the entire operating sequence, that is, the insertion of the loaders in the rotating baskets with closing covers, the start of the centrifugation cycle, the stopping of the operation, the opening of the covers and extraction of the loaders with the reels already worked on, rotation of the carousel conveyor with insertion of the new loaders, closure of the covers and start of a new cycle.

The apparatus will now be described in more detail by reference to the accompanying drawings of which:

Figure 1:
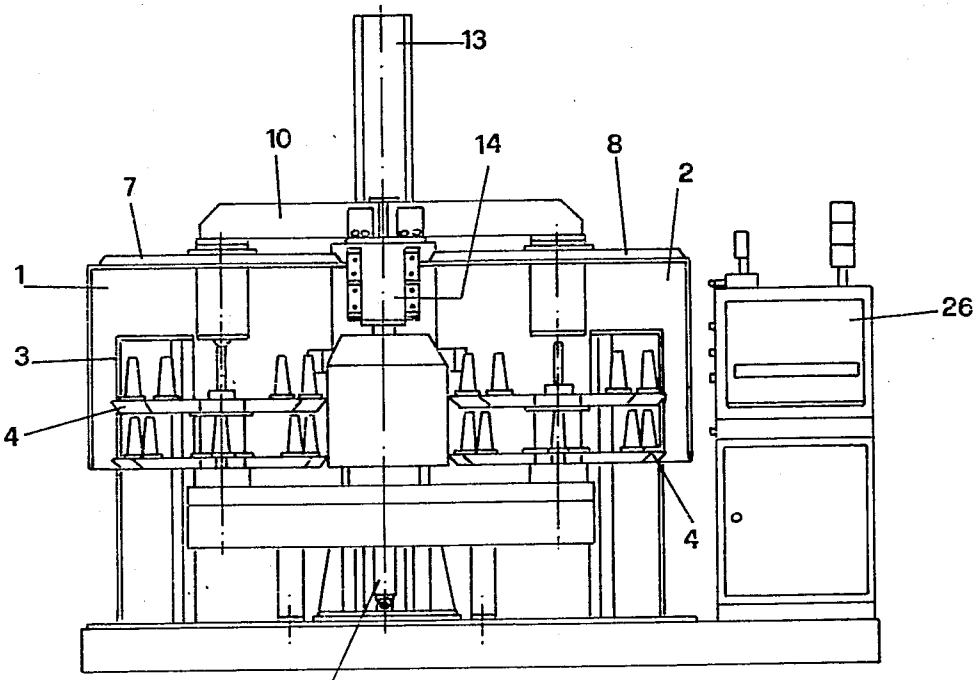
FIG. 1 illustrates a front view of the entire apparatus of the present invention.
Figure 2:
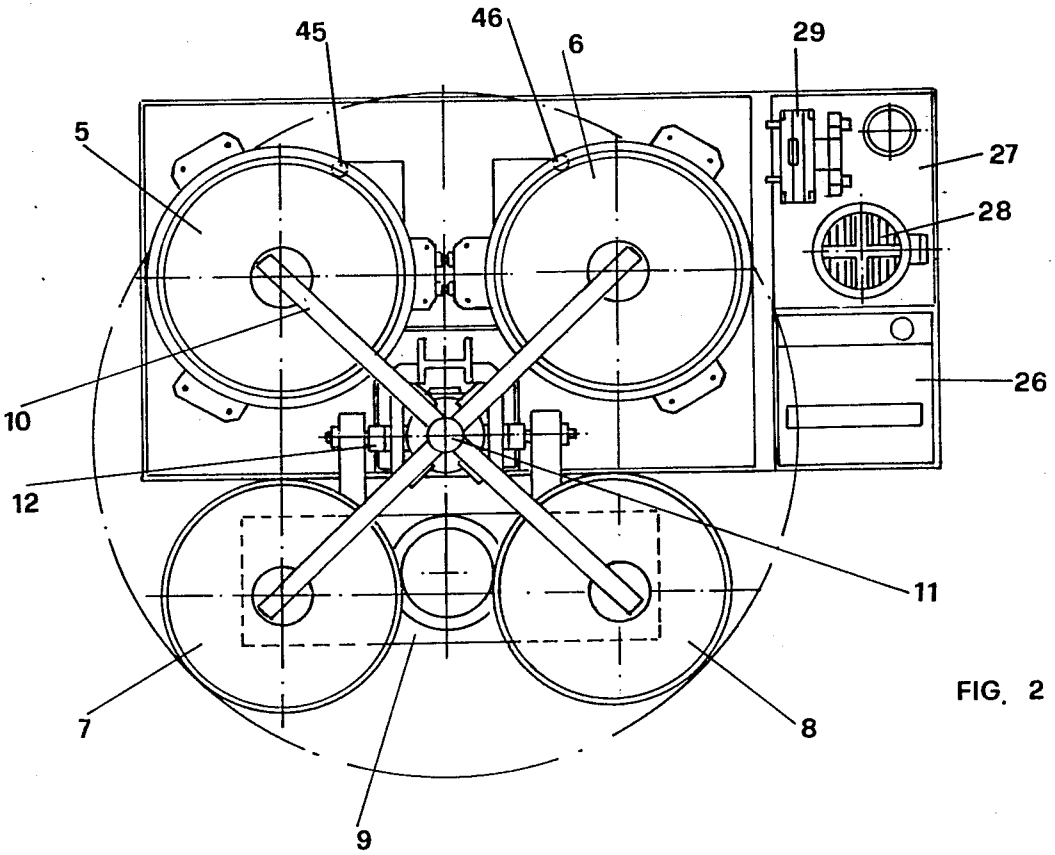
FIG. 2 illustrates a top view of the entire apparatus of the present invention.
Figure 3:
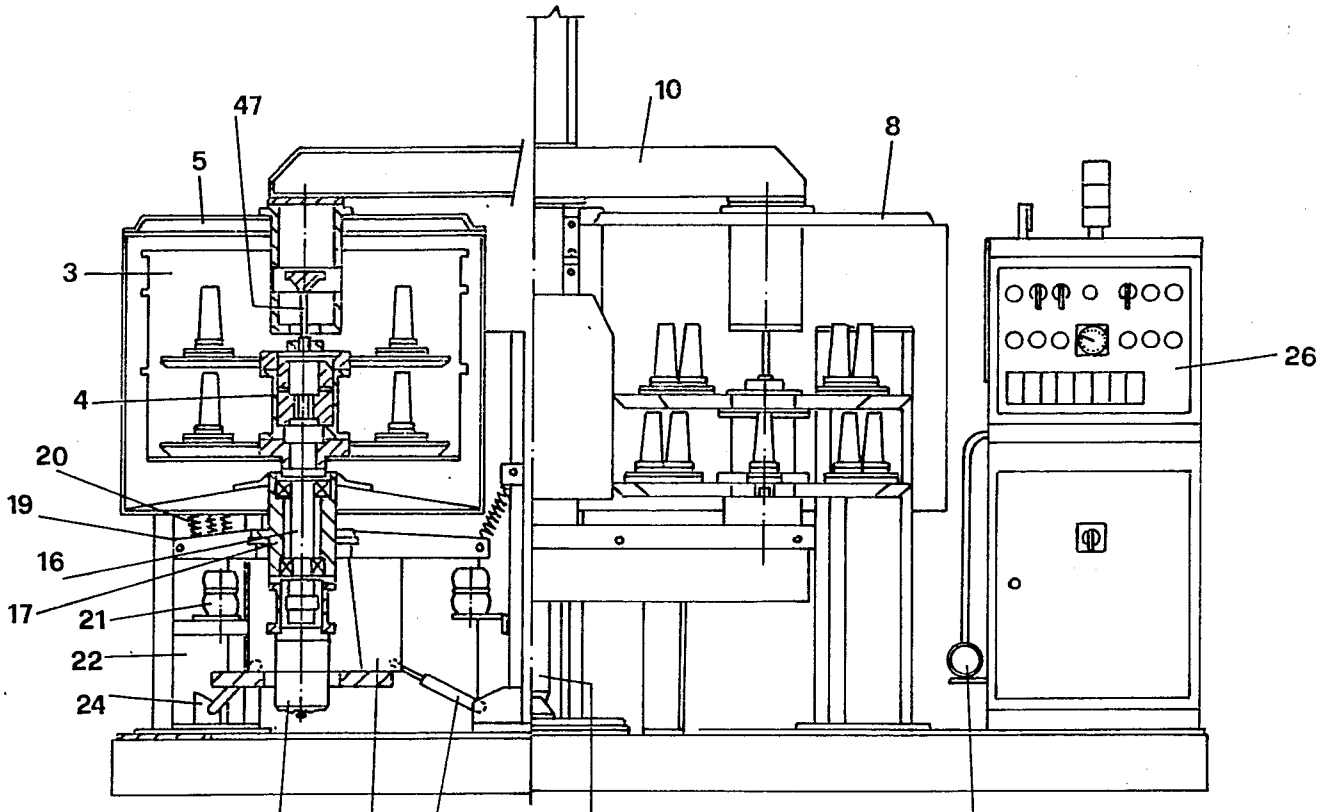
FIG. 3 is a front view of the apparatus which is partially shown in cross-section.

As shown in FIGS. 1, 2 and 3 of the drawings, the apparatus comprises a first group of structures, in this case two basins 1 and 2 which are externally fixed, within which baskets 3 rotate. The baskets support the loaders 4. The covers 5 and 6 are shown in FIG. 2. The other two covers 7 and 8 are located in the exterior of the basins and another pair of loaders is located under these covers. These two loaders rest on loading plane 9 where the reels already worked on are unloaded and where the loaders are loaded with reels to be worked on.

The covers and the loaders are mounted on a carousel conveyor which rotates and which has four arms 10. The carousel conveyor is provided with a central shaft 11 and is placed in rotation by the hydraulic control piston 12. The apparatus provides for the entire assembly to be lifted and to be lowered, guided by the column 13 which has the shape of a double T by means of a suitable trolley 14 which is actuated by the hydraulic piston 15. Numerals 45 and 46 in FIG. 2 designate the discharge conduits from which the liquid is eliminated. Numeral 47 in FIG. 3 designates a flange provided with a central shaft for raising the loaders to cause the loaders to come out from the baskets and to be placed on the loading-unloading plane.

FIG. 3 shows that each assembly comprising the rotating basket 3, the loader 4, the shaft 16, the sleeve 17 which guides the shaft, and the hydraulic motor 18 is suspended from an oscillating frame 19 which has three spokes, the frame being subjected to the action of the traction springs 20 which permit a resilient oscillation within predetermined limits. In case one or more of the springs breaks, the apparatus is provided with plugs 21 which serve as a safety and which are anchored in a fixed position on each of the legs 22.

Numeral 23 designates shock absorbers which are fixed on one side by means of suitable brackets 24 to the legs 22 and on the other side they are fixed to the brackets 25 which are part of the oscillating frame 19. In this manner they substantially cut down the noise of the movable assembly during the cycle of centrifugation.

The control board 26 actuates the hydraulic gearbox 27 which comprises electric motor 28, the triple pump being placed in the interior of the electrovalve 29 and the heat exchanger 30. The latter, as shown in FIG. 3, serves the purpose of cooling the oil, the pump actuating the entire device both at low, as well as high pressure.

Figure 4:
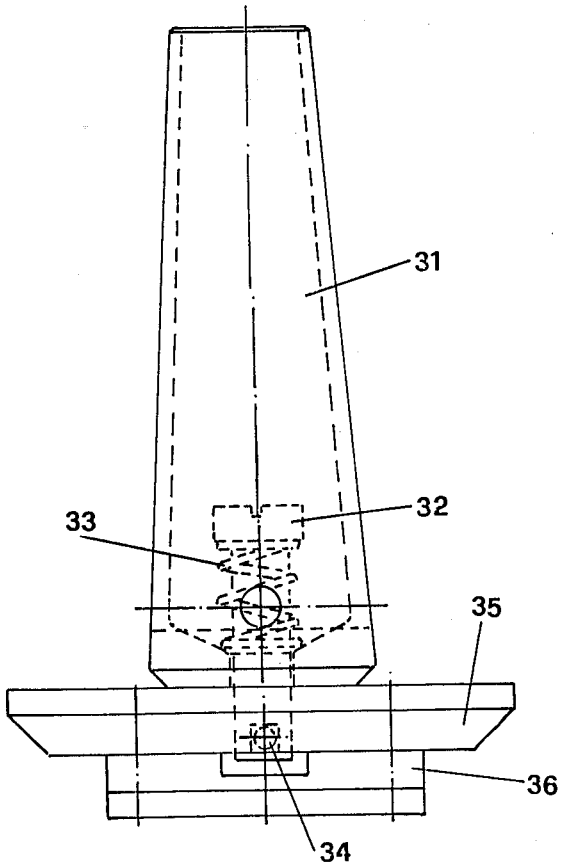
FIG. 4 is a side view of a support adapted to supporting one reel.
Figure 5:
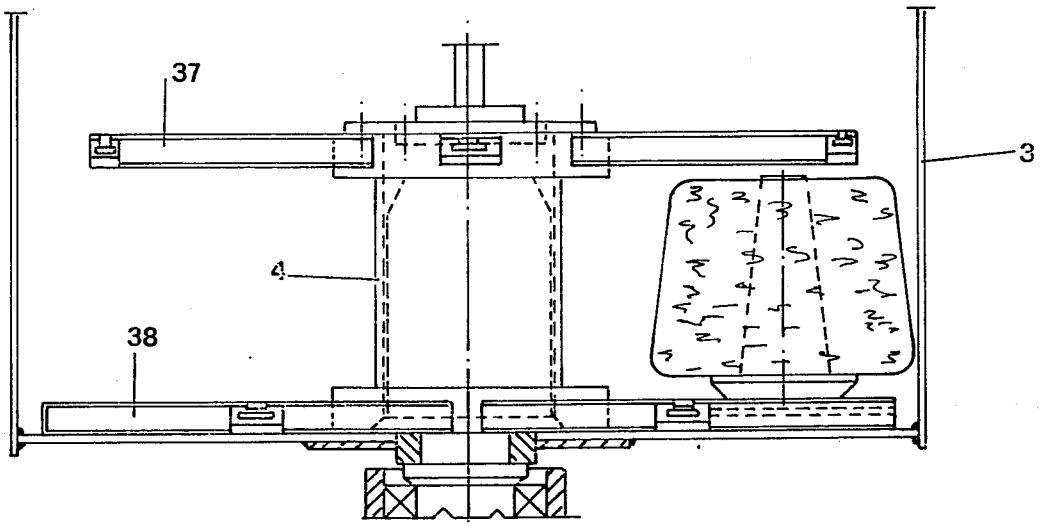
FIG. 5 is a front view in cross-section of one rotating basket having in the interior a loader with the reel vertically mounted.

FIG. 4 shows one embodiment of a support for a movable reel formed by a core 31 which has a truncoconical shape, but it could also be cylindrical. The core is resiliently fixed by means of pin 32, springs 33 and resilient peg 34 to the base 35, the latter being provided with a lower guide 36 which may slide within the slits formed on the spokes 37 and 38 of loaders 4, as shown in FIG. 5. The particular structural details of the loaders will be explained in more detail hereinbelow with reference to FIGS. 7 through 10.

Figure 6:
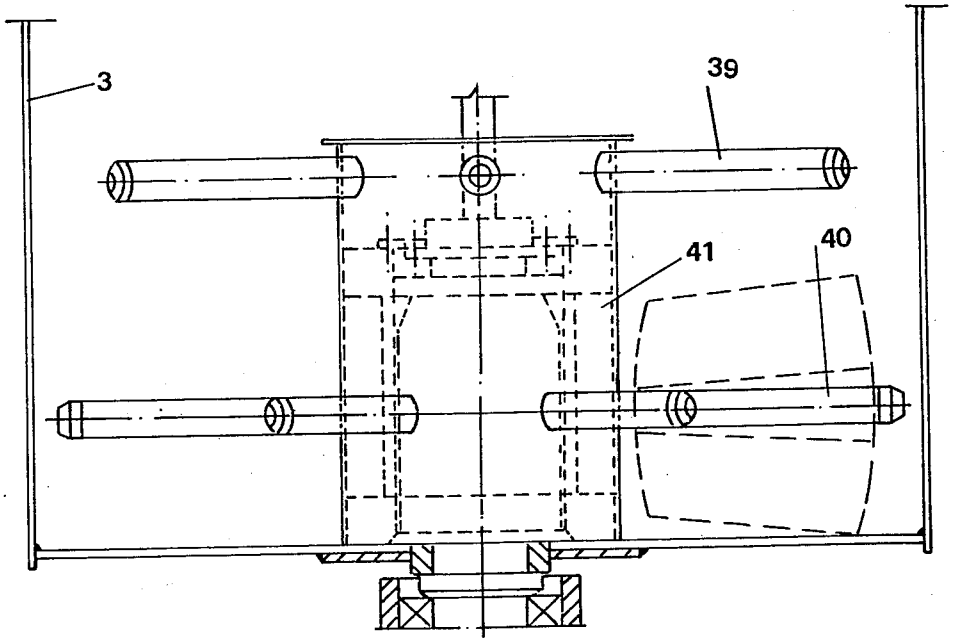
FIG. 6 is a front view in cross-section of a rotating basket with the modification of the loader having stakes with horizontal axes.

According to another embodiment of the invention, the reels may be inserted on radial stakes 39 and 40, as shown in FIG. 6 which are fixed to the central sleeve 41.

With the latter embodiment, it is possible to avoid the drawbacks of deformation of the lateral surface of the reel which is piled up on the internal surface of the rotating basket 3 due to the centrifugal force. This embodiment is conveniently used for the type of very delicate yarns. Obviously, several types of loaders may be used.

Figure 7:
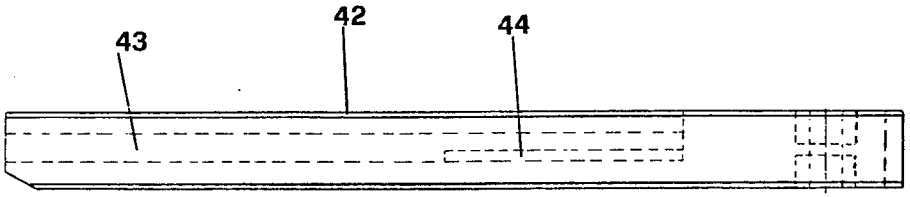
FIG. 7 is a side view of one single spoke forming the loader of FIG. 5.
Figure 8:
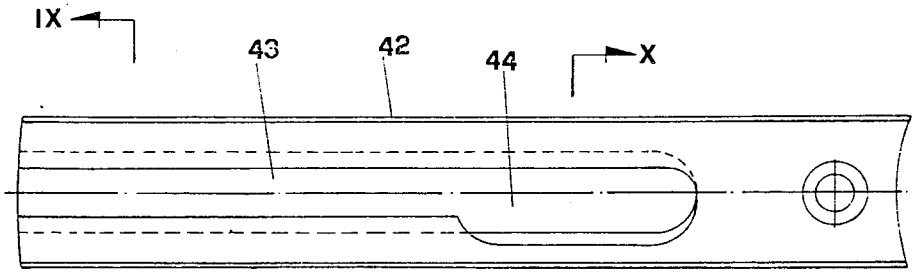
FIG. 8 is a top view of the same.
Figure 9:
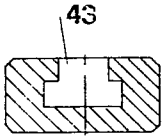
FIG. 9 is a cross-section along line IX—IX of FIG. 8.
Figure 10:
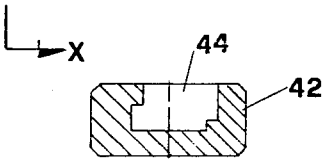
FIG. 10 illustrates a cross-section of FIG. 8 along line X—X.

FIGS. 7 and 8 illustrate the embodiment of the spoke 42 of loader 4 in which a groove 43 is formed, the groove being larger in the rear portion 44 for the purpose of allowing the introduction of guide 36, as shown in FIG. 4, the guide emerging from the lower part of the base 35 of the support for the reels 31. FIGS. 9 and 10 illustrate respectively transverse cross sections along lines IX—IX and X—X of the spoke 42.

Thus, it can be seen from the above that the apparatus operates as follows:

Four reels 50 with the yarn wound on them are placed on the loaders 4, which are placed within baskets 3, and are subjected to centrifugation under the action of motor 18. This portion of the apparatus is illustrated in FIG. 3. The loaders are mounted on the carousel conveyor in such a manner that two loaders at any one time are in the engaged position for hydroextraction within the baskets (loaders with covers 7, 8 in FIG. 1 or covers 5, 6 in FIG. 2) and two other loaders are outside of the baskets (loaders with covers 7, 8 in FIG. 2) and are on the loading-unloading plane 9. This motion is accomplished by means of the carousel conveyor which rotates 180° under the action of piston 12 and lifts itself and lowers itself under the action of piston 15. The reels 50 only move radially. As shown in FIG. 4, the support for the reel consists of a core 31 which is mounted on base 35 by means of resilient peg 34 and spring 33 and pin 32. The base 35 has guide 36 which slides within slits or grooves 43 formed in the spokes (37, 38, 42). The guide is inserted through the larger portion 44 of the slit or groove 43 and is held in the narrower portion of the groove as shown in FIGS. 8, 9 and 10.

During centrifugation, the reels are pushed against the interior walls of the baskets due to the engagement of the guide 36 with the slits 43 and the resilient construction of the reel.

Clearly, other variations of the present invention may be provided because the figures illustrate only examples which are not intended to limit the invention and modifications may be made, particularly with respect to the number and the volume of the reels being treated. For instance, the spokes of the loaders may be in a number of five, six or eight, while keeping the essential features of the invention constant. Other variations may be made with respect to the types of loaders. All these modifications fall within the scope of the invention.

What is claimed is:

1. An hydroextractor for yarns wound on reels for removal of the liquid by exposure to centrifugation after the yarns have been immersed in a dyeing bath, which comprises a carousel conveyor (10) having four arms, a piston (15) for lifting and lowering said conveyor, a control piston (12) for rotating said conveyor 180°, two fixed basins (1, 2), baskets (3) within the basins, said baskets being perforated, reels having yarns wound thereon mounted in the interior of the baskets, a first pair of loaders (4) supporting said reels in the interior of said baskets, said loaders being supported by said baskets and being mounted on two of said arms of said carousel conveyor, said loaders rotating at high speed together with said baskets, a first pair of covers (5, 6) adapted to cover said baskets, whereby when said carousel conveyor is lifted and rotates by 180° and when said covers (5, 6) are opened, it extracts from said baskets said loaders (4) with the reels on which the yarns have already been exposed to centrifugation, and the liquid goes through the perforations of the baskets, is introduced into the basins (1, 2) and is then eliminated through discharge conduits (45, 46), a second pair of covers (7, 8), a second pair of loaders located outside of said basins, said second pair of loaders located below said second pair of covers (7, 8) and mounted on the two other arms of said conveyor and on a loading and unloading plane (9), and when said conveyor is lowered it loads on said plane (9) said reels on which the yarns have been already exposed to centrifugation, it loads two loaders with reels thereon having yarn to be exposed to centrifugation on said loading and unloading plane (9), whereby while two reels on a pair of loaders are in position for hydroextraction, the other pair of loaders is being loaded.

2. An hydroextractor according to claim 1 wherein each loader which carries the reels comprises a central sleeve (41), a plurality of stakes (39 and 40) being radially fixed on said sleeve, said reels containing the yarn to be exposed to centrifugation being inserted on said sleeve, said reels being capable of being radially displaced while still remaining within the internal walls of said baskets (3) during centrifugation.

3. An hydroextractor according to claim 1 wherein the rotating baskets have internal walls, each of said reels is supported by a support comprising a core (31) and a base (35), said core being resiliently mounted on said base by means of a pin (32), a spring (33), and a resilient peg (34), said base being provided with a lower guide (36), said loaders have spokes (37, 38, 42), said spokes have slits, said guide (36) sliding within said slits, whereby radial sliding of the reel occurs and each of said reels is pushed by centrifugation against the internal walls of the rotating baskets (3).

4. An hydroextractor according to claim 1 wherein each loader during centrifugation operates in the interior of a basket (3), and wherein said loader (4) has a shaft (16), a sleeve (17) for guiding the shaft, said basket (3), said loader (4), said shaft (16), said sleeve (17) and an hydraulic motor form an assembly, said assembly is hung on an oscillating frame (19), said frame having three spokes, said frame being subjected to the action of traction springs (20) which permit a resilient oscillation within predetermined limits, and the hydroextractor comprises legs (22), plugs (21) anchored in fixed position on each of said legs (22), shock absorbers (23) fixed on one side to said legs (22) by means of suitable stakes (24), and on the other side to stakes (25) which are part of said oscillating frame (19) whereby the noise of the movable assembly is reduced during centrifiguration, even at high speed.

* * * * *